United States Patent [19]

Bleeck et al.

[11] Patent Number: 4,473,397

[45] Date of Patent: Sep. 25, 1984

[54] FOAM PREVENTION COMPOSITIONS AND PROCESSES FOR USE IN STEEL PRODUCTION

[75] Inventors: Ulrich Bleeck, Eglsee, Fed. Rep. of Germany; Alfred Freissmuth, Hadermarkt, Austria; Dietrich Radke, An der Hoffnung, Fed. Rep. of Germany

[73] Assignee: SKW Trostberg Aktiengesellschaft, Trostberg, Fed. Rep. of Germany

[21] Appl. No.: 358,972

[22] Filed: Mar. 17, 1982

[30] Foreign Application Priority Data

Mar. 18, 1981 [DE] Fed. Rep. of Germany ..... 3110569

[51] Int. Cl.[3] ..... C21C 7/00

[52] U.S. Cl. ..... 75/52; 75/51; 75/58; 75/60

[58] Field of Search ..... 75/51–58, 75/60

[56] References Cited

U.S. PATENT DOCUMENTS

| | | | |
|---|---|---|---|
| 4,242,126 | 12/1980 | Freissmuth | 75/58 |
| 4,260,413 | 4/1981 | Freissmuth | 75/58 |
| 4,260,417 | 4/1981 | Bartos | 75/58 |
| 4,358,312 | 11/1982 | Braun | 75/58 |

*Primary Examiner*—Peter D. Rosenberg
*Attorney, Agent, or Firm*—Felfe & Lynch

[57] ABSTRACT

The present invention provides a process for preventing foaming over in the case of converting pig iron into steel, as well as for lowering the phosphorus content, by blowing in oxygen in the presence of basic, slag-foaming materials, with the simultaneous blowing of finely particulate calcium carbide into and/or on to the melt, wherein finely particulate calcium carbide is introduced in an amount corresponding to the oxygen excess of the slag at the point of time at which the rate of decarbonizing increases, the slag foams up and/or the slag indicates an increased oxygen potential.

The present invention also provides a composition and apparatus for carrying out this process.

16 Claims, 2 Drawing Figures

Conductivity Measurement
(Foaming of Slag)
dC/dt
Calcium Carbide Feed
Scale Units
ΔÛc,x
Ûc
t1
tx
t2
Time Range of C- and P- Content at varying FeO-Content of Calcium basic Slags in $O_2$ Blow Process with and without $CaC_2$-additions with low C-Content Metal

FOAM PREVENTION COMPOSITIONS AND PROCESSES FOR USE IN STEEL PRODUCTION

This invention relates to a process and composition for preventing foaming over when converting pig iron into steel, and for the simultaneous reduction of the phosphorus content therein. In addition, the invention provides a device for carrying out the process. Essentially, the invention is applicable to the conversion of pig iron into steel by blowing in oxygen in the presence of basic slag-forming materials.

It is known to convert carbon-containing pig iron into steel by blowing with oxygen, with the simultaneous addition of lime. These methods, known as conversion processes, include the blowing on process and the bottom-blowing conversion process, depending upon whether the oxygen is blown in with the use of a lance from above or through nozzles present in the base of the converter.

Especially in the case of the blowing on process, it is possible to influence the slag formation by an appropriate adjustment of the distance of the lance. In this manner, due to combustion of the silicon contained in the metal melt, there is first formed a slag rich in silicic acid and iron (II) oxide to which an appropriate amount of lime is added, which dissolves in the slag. In the course of the conversion process, this slag desposits very finely divided solid particles, resulting in an increase of its viscosity, whereas the iron oxide activity in the liquid residual slag assumes a very high value which is the greater, the higher is the iron oxide content of the slag at the commencement of this critical phase. At the same time, the solid precipitated particles act as decarbonising nuclei which, in the case of a high iron oxide activity, considerably stimulate decarbonisation. In the case of an increase in the volume of gas to be removed, the slag foams over the edge of the converter and results in undesirable losses of metal. Attempts have already been made to limit foaming over by reducing the slag viscosity by adding soda, fluorite or bauxite. However, in this case, it is necessary to put up with considerable disadvantages, such as an increased corrosion, deposition problems, evolution of hydrogen fluoride and the like.

Furthermore, attempts have also been made to add a fuel in the course of adding particulate calcium carbide at the commencement of the blowing process in order, due to the reaction of the calcium carbide with oxygen, to obtain process heat for increasing the proportion of scrap iron which can be used. In this case, it is disadvantageous that the particulate calcium carbide is, to a large extent, enveloped by the slag without dissolving so that, at the end of the melting process, it is still to be found in considerable amounts in unreacted form in the slag. As a result of a sudden reaction, this carbide can also increase the tendency to the formation of ejections. An improvement of the blowing behaviour could not be achieved in this way. Furthermore, additional amounts of fluorite must be introduced.

Federal Republic of Germany Patent Specification No. 1,583,217 describes a basic steel production process in which calcium carbide in the form of the molecular compound $CaC_2$—$Cac_2.CaO$ or a mixture of $CaC_2$ and CaO corresponding to the composition of this molecular compound is blown into an iron melt in the form of a suspension in oxygen or in a carrier gas. The object of this process is to increase the amount of scrap iron or of ore in the charge in that additional heat is supplied thereto. The problems of increased slag viscosity and of increasing ejections depending upon the point of time of addition, which occur in the case of blowing in calcium carbide, are not discussed in this Patent Specification.

Furthermore, Federal Republic of Germany Patent Specification No. 2,758,477 describes a process for treating iron melts and for increasing the proportion of scrap iron in the converter, according to which oxygen or an oxygen-containing gas is blown into or on to the iron melt with calcium carbide and possibly other oxidizable substances and/or alloy formers and/or slag formers. In this way, the oxidation of alloying metals is said to be further suppressed, the output of effective alloying elements controlled upon tapping off and the oxygen adjusted in such a manner that particular steel qualities can be produced or a suitable slag is formed, the iron(II) oxide content of which is as small as possible, the life of the converter cladding is prolonged and foaming over of slag is avoided. This prior art contains no indication of the point of time of the conversion process and of the amount in which the calcium carbide is to be added in order to avoid the mentioned disadvantages.

It is also known to determine the course of the rate of decarbonising dC/dt in the course of the process by determining the proportion of carbon monoxide and carbon dioxide in the exhaust gas, from the amount of oxygen introduced into the process and the given off carbon there is continuously calculated the ratio $(\dot{O})_c$ of the introduced amount of oxygen to the amount of oxygen reacted with the carbon, from measurements of the blowing noise the degree of filling of the converter and to determine the foaming of the slag by means of conductivity measurements. On the basis of these possibilities of technical measurement, the commencement of the critical process, namely the commencement of the foaming, can be recognized and statements made regarding the oxygen potential fed into the slag.

It is an object of the present invention to improve the blowing behaviour of the process of converting pig iron into steel and decisively to lower the phosphorus content of the melt, without having to put up with the disadvantages discussed above.

Thus, according to the present invention, there is provided a process for preventing foaming over in the case of converting pig iron into steel, as well as for lowering the phosphorus content, by blowing in oxygen in the presence of basic, slag-foaming materials, with the simultaneous blowing of finely particulate calcium carbide into and/or on to the melt, wherein finely particulate calcium carbide is introduced in an amount corresponding to the oxygen excess of the slag at the point of time at which the rate of decarbonising increases, the slag foams up and/or the slag indicates an increased oxygen potential.

The amount of finely particulate calcium carbide added is preferably less than the amount which results in a collapsing of the slag.

The present invention also provides an agent and a device for carrying out the process.

In carrying out the process of the present invention, the commencement of foaming is ascertained in a known manner by means of a conductivity measurement of the slag and/or by means of the degree of filling of the crucible or converter determined by measurement of the blowing noise.

According to a preferred embodiment of the process according to the present invention, the course of the rate of decarbonising dC/dt in the course of the process is monitored in known manner by determining the proportions of carbon monoxide and carbon dioxide in a the exhaust gas and the increase of the rate of decarbonising is ascertained in order then to add the finely particulate calcium carbide at that time.

According to a further embodiment of the present invention, from the amount of oxygen introduced into the process and the given off carbon there is continuously calculated, via the ratio ($\dot{O}_C$) of the amount of oxygen introduced into the amount of oxygen reacted with carbon, the oxygen potential of the slag in known manner and the increase of the oxygen potential of the slag ascertained in order, in this way, to obtain an indication of the point of time for adding the calcium carbide.

According to the present invention, the calcium carbide is blown into or on to the melt in an amount which depends upon the oxygen excess of the slag to be estimated from the above-discussed measurement values. The calcium carbide is thereby preferably added in an amount corresponding to the following equation:

$$M_{CaC2} = K \int_{t_1}^{t_2} [(1 - \dot{O}_C)\dot{O}_{2(blas)}]dt \quad (1)$$

wherein $M_{CaC2}$ is the amount of calcium carbide, K is a proportionality factor which is determined empirically according to the type and size of the crucible, as well as in dependence upon various other factors influencing the blowing process, K having a value in the range of from 0.2 to 2, $\dot{O}_C$ is the ratio of the amount of oxygen introduced to the amount of oxygen reacted with the carbon, $\dot{O}_{2(blas)}$ is the total amount of oxygen blown in, $t_1$ is the point of time of the drop of the value of $\dot{O}_C$ and $t_2$ is the point of time of adding the calcium carbide.

The point of time of addition to be used according to the present invention can extend up to the equivalence point of the oxygen introduced. The period of addition is thereby dependent upon the rate of addition. The period of time $t_1$ to $t_2$ (increase of the oxygen potential) corresponds to the amount of oxygen equivalent to the integral $$M_{CaC2} = K \int_{t_2}^{t_2} \Delta\dot{O}_C dt \quad (3)$$

which, by definition, has been taken up by the slag, for example an increase of the FeO content of the slag from 15 to 25% of the total amount of slag.

Surprisingly, we have found that during this period of time selected according to the present invention, by the addition of the above-defined amount of finely particulate calcium carbide in the course of the conversion process, the effect of defoaming and simultaneously a high removal of phosphorus from the metal melt are achieved, which fulfil the following equation:

$$[P] = f\left( \int_{t_1}^{t_2} \Delta\dot{O}_C dt,\ M_{CaC2} \right) \quad (2)$$

wherein $\Delta\ \dot{O}_C$ is influenced by the adjustment of the distance of the oxygen nozzle from the bath and this procedure is controlled by a controlled addition of the agent.

If, on the other hand, calcium carbide is added in an excessive amount without having regard to the possibilities of control employed according to the present invention, then, according to present experience, the foamed slag collapses completely so that the intended metallurgical treatment in the following blowing period can no longer be carried out to a sufficient extent. The formation of foamed slag in the LD process is especially important for metallurgical reasons and is also especially advantageous for the removal of harmful materials accompanying pig iron and steel, such as phosphorus and sulphur.

If the addition of calcium carbide first takes place with the commencement of foaming over, this foaming over can only be alleviated by an excessive rate of addition and an excessive amount since finely particulate calcium carbide also has a finite reaction time. However, with the help of the process according to the present invention, it is readily possible to maintain the foamed slag and, at the same time, to prevent foaming over of the slag in the converter or crucible. It is also surprising that the point of time of the optimum carbide addition for the suppression of foaming coincides with the optimum point of time of the lowering of the phosphorus content in the case of comparatively high carbon contents of the melt of, for example, 1.0 to 0.3% carbon, to values hitherto not achieved in the conversion process.

However, this can only be achieved with the help of the process according to the present invention if the addition of calcium carbide takes place at the correct point of time and the amount added does not result in a collapse of the slag, i.e. the amount of calcium carbide added corresponds to the above-defined amount added according to the present invention. It is known that the oxygen potential can be altered by altering the distance of the oxygen nozzle from the metal melt, an increase of this distance resulting in a lowering of the value of $\dot{O}_C$.

Furthermore, we have found that by means of the addition according to the present invention of finely-particulate calcium carbide, the desulphurising during the process can also be improved.

It is well known that an insufficient mixing up of bath and slag at the end of the blower results in disequilibria and in a non-exhaustive slag-metal melt reaction. If the phosphorus content of the metal melt is taken as a characteristic for the procedure, then it is found that below a carbon content of 0.08% in the metal, no further substantial removal of phosphorus takes place even when in lime-saturated slags the FeO content is considerably further increased.

Surprisingly, by blowing finely particulate calcium carbide into such slags with increasing FeO content, it is possible further to carry out the phosphorus removal reaction between metal melt and slag in the direction of a further removal of phosphorus by combustion of the carbon of the calcium carbide by a simultaneous introduction of oxygen, as well as due to the introduction of calcium oxide resulting from the calcium carbide by reaction with oxygen, a final phosphorus content of less than 0.005% phosphorus thereby being achieved. In the case of this method of operating, it appears to be possible to achieve the necessary bath movement for the slag-metal melt reaction by means of the carbon monoxide resulting from the reaction. However, according to the present invention, this effect can only be achieved when the reactive amount of oxygen present in the slag in the form of iron oxide, in combination with the simultaneously blown in amount of oxygen, are comparatively greater than or equal to the amount of oxygen needed for the reaction with calcium carbide and the $(FeO)_n$ contents in the lime-saturated slag accordingly obtained come very close to the value with which the finally desired phosphorus content stands in equilibrium and obey the functional relationship according to equation 2. The final sulphur contents can thereby also be lowered.

According to the present invention, this process requires a rate of addition of the calcium carbide which, according to a preferred embodiment of the heredescribed process, corresponds to a rate of reaction of the carbon in the converter of at least 0.3 and preferably of 0.5 kg C/t.min. and thus also leads, in the case of an already very low carbon content in the metal melt, to a renewed reaction of the carbon with oxygen, the necessary movement between bath and slag thereby being ensured.

According to a preferred embodiment of the process according to the present invention, it is carried out in a converter at a rate of reaction of the carbon of 0.5 to 1.0 or also of up to 2.0 kg. C/t.min. The maintenance of this condition can be tested by monitoring the rate of decarbonising. In the case of a sufficient rate of introduction of calcium carbide, the simultaneous introduction of oxygen must be increased to such an extent that a minimum conversion of about 0.6 to 0.8 kg. C/t.min. is achieved.

Thus, a further preferred embodiment of the process according to the present invention consists in that, after lowering the carbon content of the metal to a value of less than 0.08% carbon, a further removal of phosphorus is carried out by blowing in calcium carbide and oxygen in such an amount and at such a rate that the dC/dt measurement indicates a carbon conversion of at least 0.3 kg. C/t.min. and the conductivity measurement and/or the blower noise measurement indicates "foaming slag". The addition of calcium carbide and oxygen are thereby preferably carried out in such an amount that a carbon conversion of at least 2 kg. C/t.min. is obtained.

The process according to the present invention is preferably carried out with the use of a technical grade calcium carbide containing 60 to 83% by weight and preferably 75 to 80% by weight of calcium carbide or with the use of a mixture of 60 to 90% by weight of technical calcium carbide and 40 to 10% by weight of a mixture of calcium carbonate and carbon, the carbon content of which is 5 to 20% by weight.

The present invention also provides an agent for carrying out the above-described process, which consists of finely particulate calcium carbide. The agent according to the present invention preferably consists of technical calcium carbide with a content of 60 to 83% by weight of calcium carbide. Another preferred agent according to the present invention consists of 60 to 90% by weight of technical calcium carbide and 40 to 10% by weight of a mixture of calcium carbide and carbon, the carbon content of the mixture being 5 to 20% by weight. Another advantageous agent according to the present invention consists of 40 to 90 parts by weight of technical calcium carbide and 60 to 10 parts by weight of technical calcium oxide to which an especially good flowability can possibly be imparted by the addition of silicone oil. The agent according to the present invention preferably has a particle size in the range of from 0.001 to 20 mm. and especially preferably of from 0.01 to 1.0 mm.

In carrying out the process according to the present invention, the finely particulate calcium carbide is either blown with the help of nozzles, which are arranged in the bottom of the converter, into the melt refined with oxygen, which is treated in the same way with lime-basic slag, or is blown from above on to the melt with the help of an oxygen lance.

Preferably, however, the process according to the present invention is carried out with the help of a device according to the present invention which is a known double-circle lance with the calcium carbide feed in arranged centrally in the oxygen inlet, wherein the opening of the calcium carbide inlet is retracted at least 10 mm. and preferably at least 40 mm. behind the opening of the oxygen inlet.

The present invention will now be explained in more detail with reference to the following Examples and with reference to the accompanying drawings, in which:

FIG. 1 illustrates a recorder strip which is to be seen in rectangular form with the wording "scale divisions" lying above.

The thick line below the wording "scale divisions" represents the zero point of the curves. On the y-axis there is plotted the time, $t_0$ being the starting point of the curves and on the x-axis there is plotted the scale divisions in a suitable size.

The course of the chain line represents the ratio $(\dot{O}_C)$ of the oxygen removed as carbon monoxide to the total amount of oxygen blown in. The integral over the period of time $t_1-t_2$, the surface of which is illustrated extended, is a measure of the oxygen which is not reacted with carbon and thus represents a value of the amount of calcium carbide to be introduced.

The curve dC/dt represents the course of the rate of decarbonising. This also decreases continuously according to the decreasing value of $\dot{O}_C$ and achieves correspondingly high values at the moment of the carbide addition.

The "conductivity measurement" curve permits the recognition of the strong foaming of the slag at about the time point $t_2$ and the continuous decrease of the conductivity, i.e. the collapse of the slag foam after the carbide addition.

Figure 2:
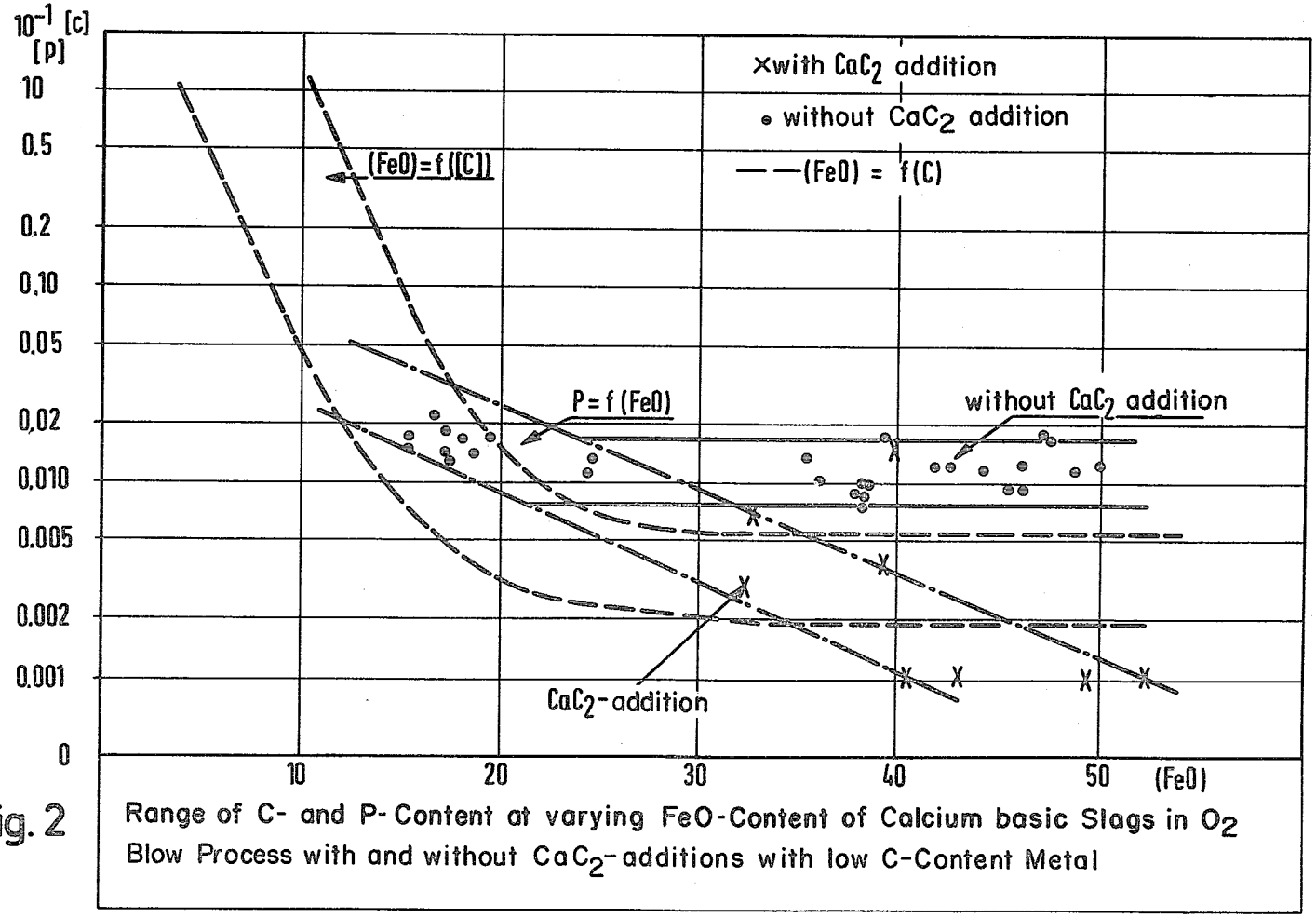
FIG. 2 shows the known dependence of the carbon concentration and phosphorus concentration on the iron(II) oxide content of calcium-saturated slags.

FIG. 2 represents the dependence of the carbon concentration and of the phosphorus concentration on the iron(II) oxide content of slags saturated with calcium oxide, which is known to metallugists. It is to be seen that in the case of treatment of the melt with calcium carbide, a reduction of the phosphorus content and of the carbon content to very low values is possible, whereas, without the addition of calcium carbide, the phosphorus content of the metal, even in the case of increasing FeO contents in the lime-saturated slag, do not drop substantially below the value which has been achieved in the case of a carbon content in the metal of 0.1%.

The following Examples are given for the purpose of illustrating the present invention:

EXAMPLE 1

Into a converter there are placed 2.2 tonnes of pig iron of the following composition:

4.4% carbon
0.8% silicon
0.7% manganese
0.1% phosphorus
0.04% sulphur the remainder being iron. In addition, 800 kg. of scrap iron are added for cooling and 120 kg. of lime for slag formation.

For monitoring the rate of decarbonisation, a measurement device is installed which continuously monitors the carbon monoxide and carbon dioxide contents of the waste gas and the amount of waste gas. Furthermore, the amount of the current of the oxygen fed in is continuously measured. From these values and with the help of a calculator there is determined, in known manner, the rate of decarbonisation dC/dt and the ratio ($\dot{O}_C$) of the totality of the oxygen supplied to the oxygen needed for the carbon reaction.

Furthermore, in known manner, there is measured the conductivity of an electric circuit which is completed via an electrically insulated suspended lance, when this dips into the slag in the converter. The conductivity of the electrical circuit increases, the higher the slag foams.

Calcium carbide is pneumatically introduced into the process via a concentric pipe in the oxygen pipe of the blowing lance.

The lime required for slag formation is introduced in the first 5 minutes of blowing.

At first, the oxygen is blown on to the melt at a nozzle distance of 1100 mm. in such a manner that a uniform decarbonising of the melt can take place. The oxygen feed in thereby takes place in an amount of 6 $Nm^3$/min.

Approximately in the fifth minute of blowing, the rate of decarbonising decreases uniformly, whereby the $\dot{O}_C$ measurement indicates a decreasing ratio of the oxygen reacted for the combustion of the carbon. At this time, the slag is excessively enriched with oxygen. From the course of the $\dot{O}_C$ measurement, it is possible to estimate that the amount of oxygen additionally introduced into the slag in the next minutes can be stoichiometrically bound by about 15 kg. calcium carbide.

Figure 1:
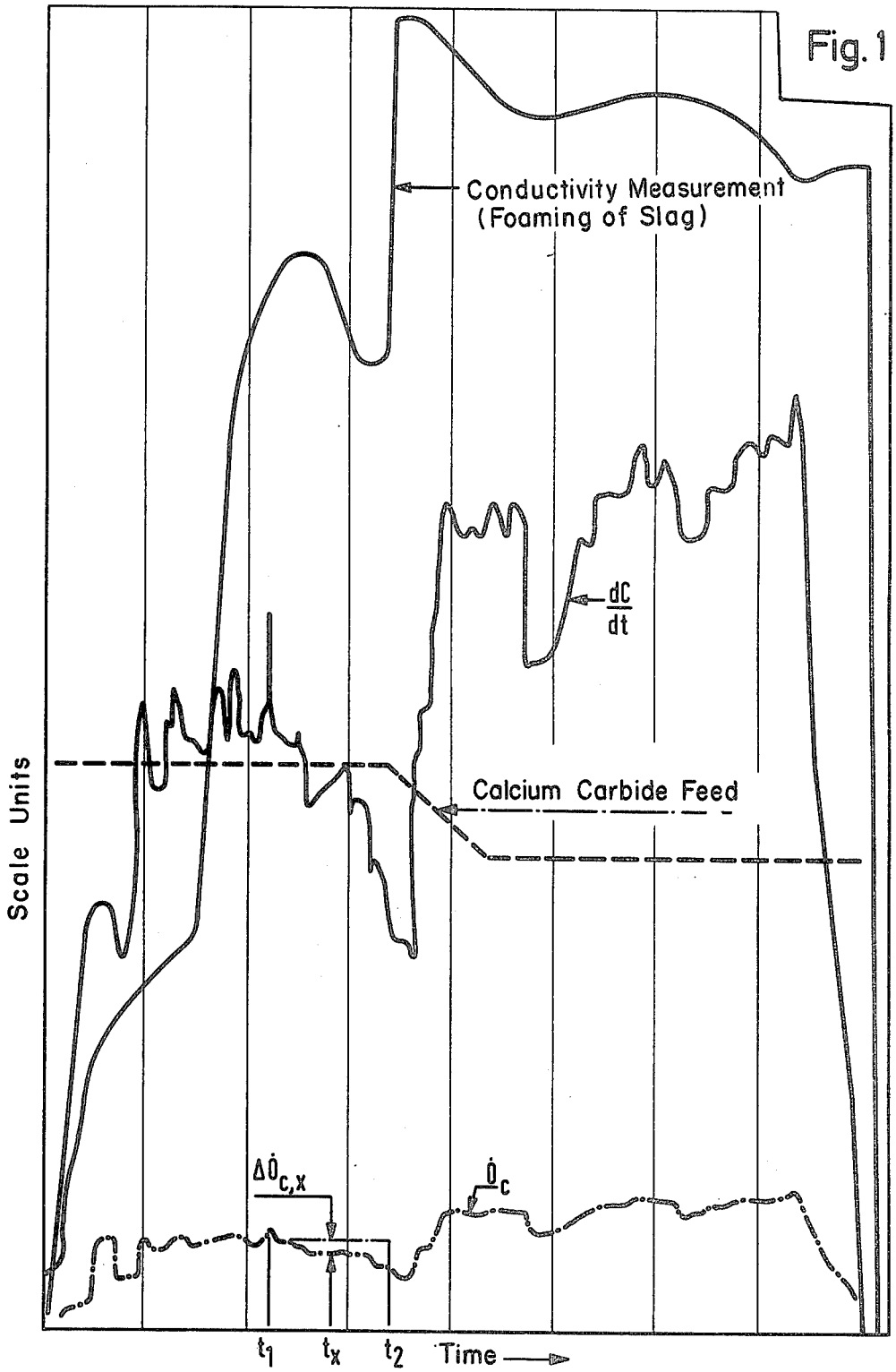
FIG. 1 shows the time dependence of the conductivity of -he slag, the rate of decarbonising and the change of the value of $\dot{O}_C$ in the case of an addition of calcium carbide.

FIG. 1 shows the course of dC/dt measured in this melt, $\dot{O}_C$ and the conductivity measurement. The value $\Delta\ \dot{O}_{C,x}$ entering into the calculation according to the above-given equation at the time $t_x$ is illustrated in FIG. 1. The point of time of the addition of the calcium carbide is also given in FIG. 1.

At the commencement of the foaming, which is ascertained with the help of the conductivity measurement, the rate of decarbonising also increases. The simultaneous addition of 15 kg. of calcium carbide for the decomposition of the excess amount of oxygen taken up by the slag in conjunction with a lowering of the lance to a bath distance of the oxygen nozzle of 400 mm. leads to a quiet, ejection-free further course of the blowing process. The foaming of the slag indicated by the conductivity measurement decreases slightly. In the case of comparative melts, in the same situation there is a considerable foaming over of the slag if no calcium carbide is added.

EXAMPLE 2

In another melt with the same charge, a final phosphorus content of 0.003% is to be obtained. A sample taken after tilting the converter shows, in the case of a carbon content of 0.06%, a phosphorus content of 0.025%. Under normal circumstances, in the case of correspondingly low carbon contents, a further removal of phosphorus is no longer achievable even in the case of a further addition of lime since the rates of decarbonising possible in the case of these low carbon contents in the metal no longer suffice for a sufficient mixing up of slag and metal.

In the present case, the converter is again brought into an upright position, the lance is applied at a distance of 600 mm. and an amount of oxygen of 4 $Nm^3$/min. is again blown on. At the same time, 12 kg. calcium carbide per minute is introduced through the middle pipe of the oxygen lance. The rate of decarbonising determined via the dC/dt measurement increases to about 3.5 kg. C/min. The conductivity measurement shows an intensive foaming of the slag in the converter. After the introduction of 30 kg. calcium carbide, the converter is again tilted and a sample is taken. The carbon content is still 0.06%, whereas the phosphorus content has decreased to 0.002%.

EXAMPLE 3

With the use of the same metal melt and with the maintenance of the same conditions as in Example 1, the rate of decarbonising after achieving a carbon content of 0.8% in the metal melt is knowingly reduced by increasing the distance of the lance. In this way, an increased iron oxide content of the melt can be obtained which, under conventional conditions, would have led to an increase ejection in the further course of the process. In the case of the present Example, 24 kg. calcium carbide are blown in. In this way, it is possible, after blowing in the calcium carbide at a carbon content of 0.5%, to obtain a phosphorus content of 0.02%. The final sulphur content is 0.015%.

EXAMPLE 4

In the case of another melt with a batch corresponding to Example 1, it is shown, in the case of the use of 20 kg. of a mixture consisting of 65 parts by weight of technical calcium carbide and 35 parts by weight of calcium oxide, this mixture being blown in shortly before the commencement of foaming of the slag, that not only is the foaming over of the contents of the converter prevented with certainty but also that a phosphorus content of $<0.03\%$ is achieved.

It will be understood that the specification and examples are illustrative but not limitative of the present invention and that other embodiments within the spirit and scope of the invention will suggest themselves to those skilled in the art.

What is claimed is:

1. A process to prevent foaming over and to lower the phosphorus content of steel, when converting pig iron into steel, which process comprises blowing oxygen into the pig iron in the presence of basic, slag-forming materials, while simultaneously blowing in finely particulate calcium carbide to contact the melt, wherein said calcium carbide is introduced in an amount corresponding to the oxygen excess of the slag at at a determined point in time.

2. The process of claim 1, wherein the commencement of foaming is determined by a conductivity measurement of the slag.

3. The process of claim 1, wherein the commencement of foaming is determined by the degree of filling of the crucible by measurement of the blowing noise.

4. The process of claim 1, wherein the course of the rate of decarbonization dC/dt during the proces is monitored by determining the proportion of carbon monoxide and carbon dioxide in the waste gas and ascertaining the increase of the rate of decarbonization.

5. The process of claim 1, wherein the oxygen potential is continuously calculated from the amount of oxygen introduced into the process and the carbon given off, by way of the ratio ($O_C$) of the amount of oxygen introduced to the amount of oxygen reacted with the carbon and the increase of the oxygen potential is ascertained.

6. Process as claimed in claim 1, wherein the calcium carbide is added in an amount corresponding to the equation:

$$M_{CaC_2} = K \int_{t_2}^{t_1} [(1 - \dot{O}_C)\dot{O}_{2(blas)}]dt \qquad (1)$$

wherein $M_{CaC_2}$ is the amount of calcium carbide, K is a proportionality factor with a value in the range of from 0.2 to 2, $\dot{O}_C$ is the ratio of the amount of oxygen introduced to the amount of oxygen reacted with carbon, $\dot{O}_{2(blas)}$ is the total amount of oxygen blown in , $t_1$ is the point of time of the decrease of the value of $\dot{O}_C$ and $t_2$ is the point of time of the addition of the calcium carbide.

7. Process as claimed in claim 1, wherein the calcium carbide is introduced at such a rate that there is obtained in the converter a rate of reaction of the carbon of at least 0.3 to 3.0 kg. C/t.min.

8. Process as claimed in claim 1, wherein $$[P] = f\left( \int_{t_1}^{t_2} \Delta\dot{O}_C dt,\ M_{CaC_2} \right)$$

is used as a basis for the adjustment of $$\int_{t_1}^{t_2} \Delta\ \dot{O}_C dt$$

for the achievement of a preferred removal of phosphorus, in which $\Delta\ \dot{O}_C$ is influenced by the adjustment of the distance of the oxygen nozzle from the bath and this procedure is controlled by a controlled addition of the agent.

9. Process as claimed in claim 1, wherein after lowering the carbon content of the metal to values of <0.08% C, a further removal of phosphorus is carried out by blowing in calcium carbide and oxygen in such an amount and at such a rate that the dC/dt measurement indicates a carbon reaction of at least 0.3 kg. C/t.min. and the conductivity measurement and/or the blowing noise measurement indicated "foaming slag".

10. Process as claimed in claim 9, wherein the addition of calcium carbide and oxygen is carried out in such an amount that the dC/dt measurement indicates a carbon reaction of 0.5 to 2 kg. C/t. min.

11. The process of claim 1, wherein calcium carbide with a content of 60 to 83% by weight $CaC_2$ is blown to contact the metal melt through a nozzle below the level of the bath.

12. Process as claimed in claim 11, wherein use is made of a mixture of 60 to 90% by weight of technical calcium carbide and 40 to 10% by weight of calcium carbonate and carbon, the carbon content of the mixture being 5 to 20% by weight.

13. The process according to claim 1, wherein the calcium carbide is introduced when the rate of decarbonization increases.

14. The process according to claim 1, wherein the calcium carbide is introduced when the slag foams up.

15. The process according to claim 1, wherein the calcium carbide is introduced when the slag indicates an increased oxygen potential.

16. The process according to claim 1, wherein the calcium carbide is introduced when the slag foams up and the slag indicates an increased oxygen potential.

* * * * *

UNITED STATES PATENT AND TRADEMARK OFFICE

CERTIFICATE OF CORRECTION

PATENT NO. : 4,473,397

DATED : September 25, 1984

INVENTOR(S) : Ulrich Bleeck et al.

It is certified that error appears in the above-identified patent and that said Letters Patent is hereby corrected as shown below:

Col. 1, line 63, "$CaC_2$-$Cac_2$.CaO" should be -- $CaC_2$-$CaC_2$.CaO --.

Col. 2, line 48, "slag-foaming" should be -- slag-forming --.

Col. 6, line 24, "-he" should be -- the --.

Signed and Sealed this

Thirtieth Day of April 1985

[SEAL]

Attest:

DONALD J. QUIGG

Attesting Officer

Acting Commissioner of Patents and Trademarks